US006887041B2

(12) United States Patent
Coke et al.

(10) Patent No.: US 6,887,041 B2
(45) Date of Patent: May 3, 2005

(54) AIRFOIL SHAPE FOR A TURBINE NOZZLE

(75) Inventors: Robert Wayne Coke, Mauldin, SC (US); James Bernard Fehlberg, Simpsonville, SC (US); Charles Andrew Malinowski, Mauldin, SC (US)

(73) Assignee: General Electric Company, Schenectady, NY (US)

( * ) Notice: Subject to any disclaimer, the term of this patent is extended or adjusted under 35 U.S.C. 154(b) by 182 days.

(21) Appl. No.: 10/376,246

(22) Filed: Mar. 3, 2003

(65) Prior Publication Data

US 2004/0175271 A1 Sep. 9, 2004

(51) Int. Cl.[7] ..... F01D 9/04

(52) U.S. Cl. ..... 415/191; 415/193; 415/208.2; 415/211.2

(58) Field of Search ..... 415/191, 193, 415/208.2, 211.2; 416/223 R, 243, 223 A, DIG. 2, DIG. 5

(56) References Cited

U.S. PATENT DOCUMENTS 5,980,209 A * 11/1999 Barry et al. ..... 416/223 A
6,461,109 B1 * 10/2002 Wedlake et al. ..... 416/223 R
6,503,054 B1 * 1/2003 Bielek et al. ..... 415/191

* cited by examiner

*Primary Examiner*—Ninh H. Nguyen
(74) *Attorney, Agent, or Firm*—Nikon & Vanderhye P.C.

(57) ABSTRACT

The third stage nozzle has an airfoil profile substantially in accordance with Cartesian coordinate values of X, Y and Z set forth in Table I wherein X and Y values are in inches and define airfoil profile sections at each distance Z and Z is a non-dimensional value from 0 to 1 convertible to Z distances in inches by multiplying the Z values of Table I by a height of the airfoil in inches. The profile sections at the Z distances are joined smoothly with one another to form a complete airfoil shape. The X and Y distances may be scalable to provide a scaled-up or scaled-down airfoil for the nozzle. The nominal airfoil given by the X, Y and Z distances lies within an envelope of ±0.100 inches.

10 Claims, 5 Drawing Sheets

AIRFOIL SHAPE FOR A TURBINE NOZZLE

BACKGROUND OF THE INVENTION

The present invention relates to an airfoil for a nozzle stage of a gas turbine and particularly relates to an airfoil for a third stage nozzle of a gas turbine.

Many specific requirements must be met for each stage of the hot gas path section of a gas turbine in order to meet design goals, including overall improved efficiency and loading. Particularly, the third stage of the turbine sect ion must meet efficiency, heat load, life, throat area and vectoring requirements to meet that goal.

BRIEF DESCRIPTION OF THE INVENTION

In accordance with a preferred embodiment of the present invention, there is provided an airfoil shape for a nozzle stage of a gas turbine, preferably the third stage nozzle, that enhances the performance of the gas turbine. The airfoil shape hereof improves the interaction between various stages in the turbine, affords improved aerodynamic efficiency through the third stage and improves the third stage blade loading. Thus, the profile of each second stage nozzle airfoil which in part defines the hot gas path annulus about the nozzle stage meets the requirements for improved stage efficiency, as well as parts life and manufacturability.

In a preferred embodiment according to the present invention, there is provided a turbine nozzle including an airfoil having an airfoil shape, the airfoil having a nominal profile substantially in accordance with Cartesian coordinate values of X, Y and Z set forth in Table I wherein the Z values are non-dimensional values from 0 to 1 convertible to Z distances in inches by multiplying the Z values of Table I by a height of the airfoil in inches, and wherein the X and Y values are distances in inches which, when connected by smooth continuing arcs, define airfoil profile sections at each distance Z, the profile sections at the Z distances being joined smoothly with one another to form a complete airfoil shape.

In a further preferred embodiment according to the present invention, there is provided a turbine nozzle including an airfoil having an uncoated nominal airfoil profile substantially in accordance with Cartesian coordinate values of X, Y and Z set forth in Table I wherein the Z values are non-dimensional values from 0 to 1 convertible to Z distances in inches by multiplying the Z values of Table I by a height of the airfoil in inches, and wherein the X and Y values are distances in inches which, when connected by smooth continuing arcs, define airfoil profile sections at each distance Z, the profile sections at the Z distances being joined smoothly with one another to form a complete airfoil shape, the X, Y and Z distances being scalable as a function of the same constant or number to provide a scaled-up or scaled-down airfoil.

In a further preferred embodiment according to the present invention, there is provided a turbine comprising a turbine stage having a plurality of nozzles, each of the nozzles including an airfoil having an airfoil shape, the airfoil having a nominal profile substantially in accordance with Cartesian coordinate values of X, Y and Z set forth in Table I wherein the Z values are non-dimensional values from 0 to 1 convertible to Z distances in inches by multiplying the Z values of Table I by a height of the airfoil in inches, and wherein X and Y values are distances in inches which, when connected by smooth continuing arcs, define airfoil profile sections at each distance Z, the profile sections at the Z distances being joined smoothly with one another to form a complete airfoil shape.

DETAILED DESCRIPTION OF THE INVENTION

Figure 1:
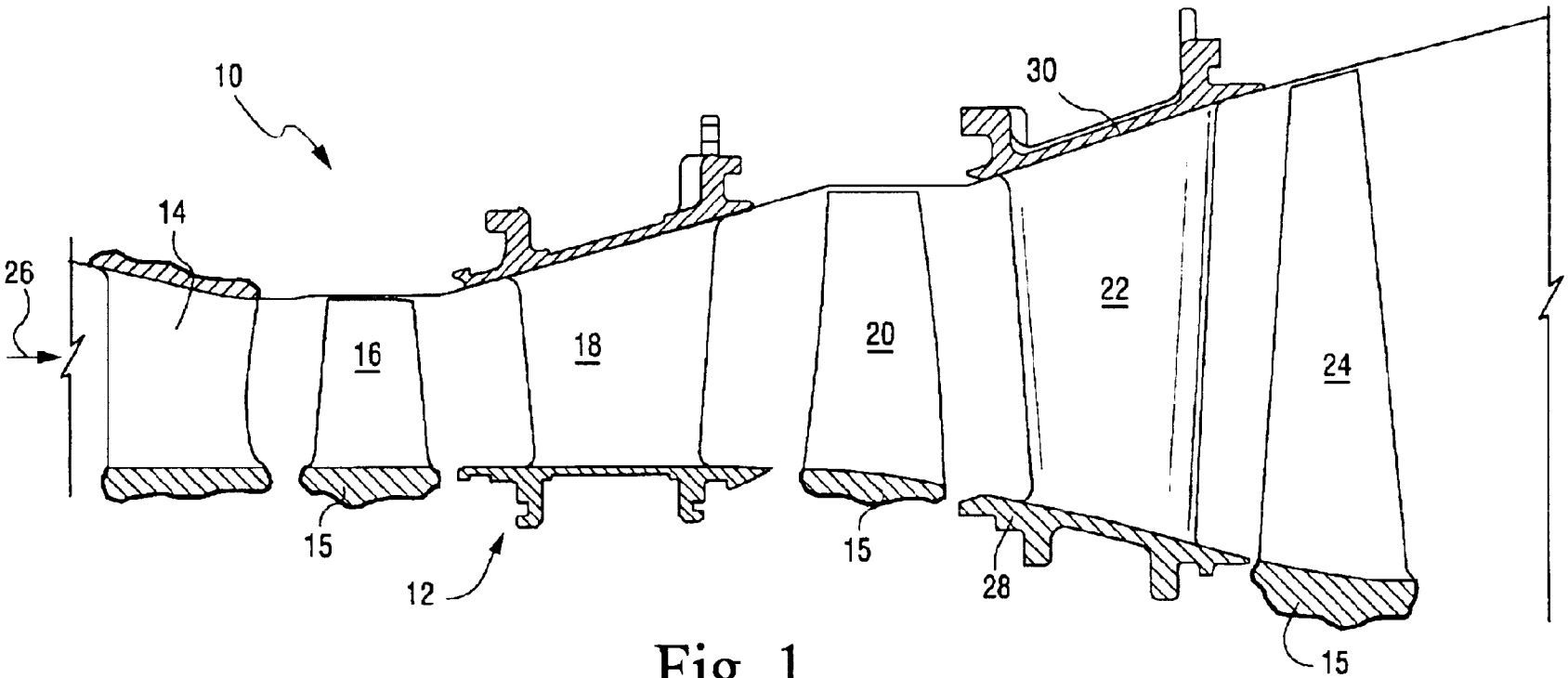
FIG. 1 is a schematic representation of a hot gas path through a gas turbine and which illustrates a third stage nozzle airfoil according to a preferred embodiment of the present invention.

Referring now to the drawings, particularly to FIG. 1, there is illustrated a multi-stage turbine section, generally designated 10, for a gas turbine 12 including a plurality of turbine stages. Three stages are illustrated. For example, the first stage comprises a plurality of circumferentially spaced nozzle or blades 14 and buckets 16, the nozzles being circumferentially spaced one from the other and fixed about the axis of the turbine rotor 15. The buckets 16, of course, are mounted on and circumferentially spaced about the rotor 15. A second stage of the turbine 12 is also illustrated, including a plurality of circumferentially spaced nozzles 18 and a plurality of buckets 20 mounted on the rotor 15. A third stage is also illustrated, including a plurality of circumferentially spaced nozzles 22 and buckets 24. It will be appreciated that the nozzles and buckets lie in the turbine's hot gas path indicated by the arrow 26.

Figure 2:
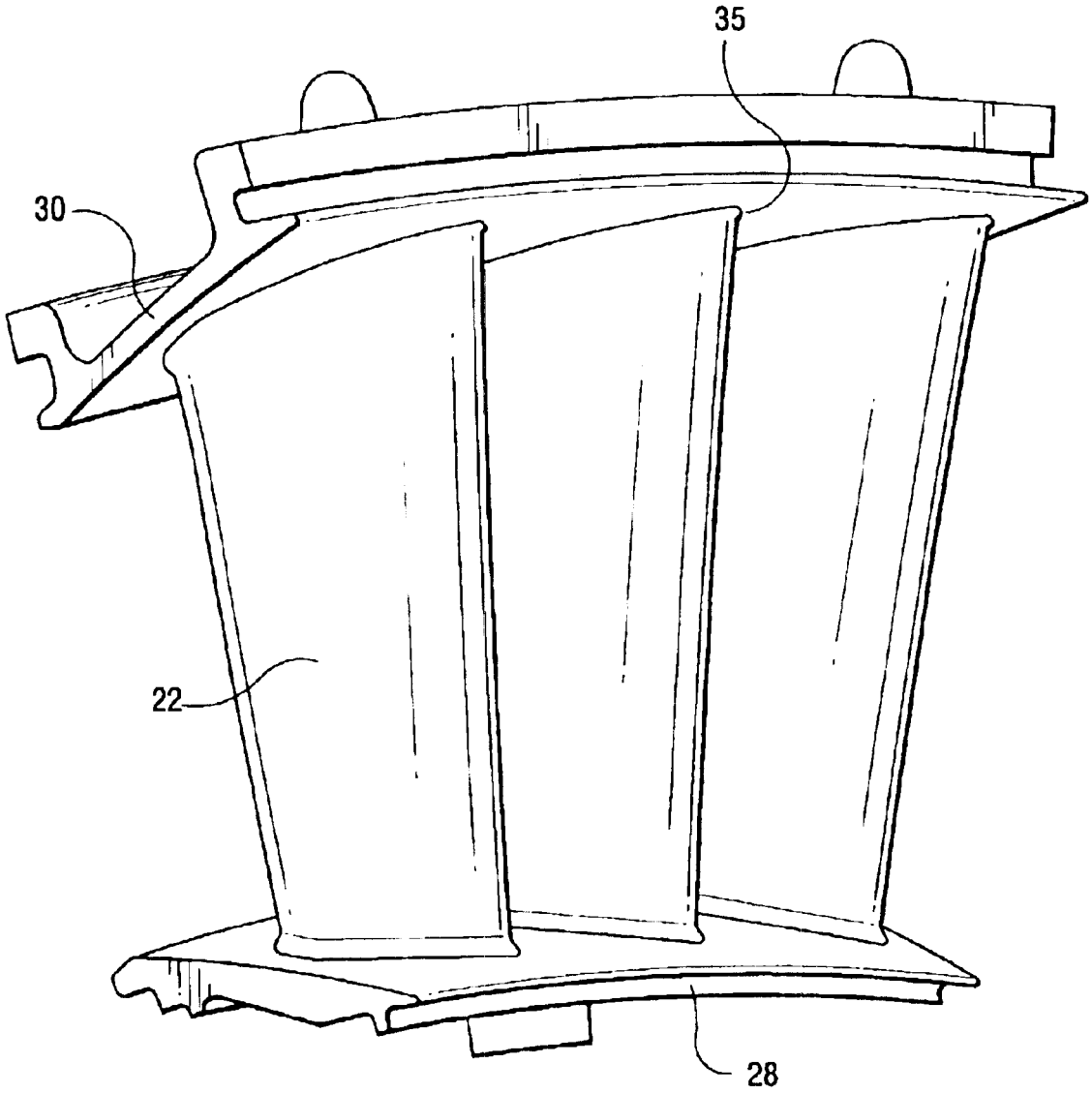
FIG. 2 is a perspective view of three airfoil blades forming portions of the third stage nozzles of the turbine according to the present invention, and including portions of the inner and outer nozzle bands, all as viewed from the trailing edges.
Figure 3:
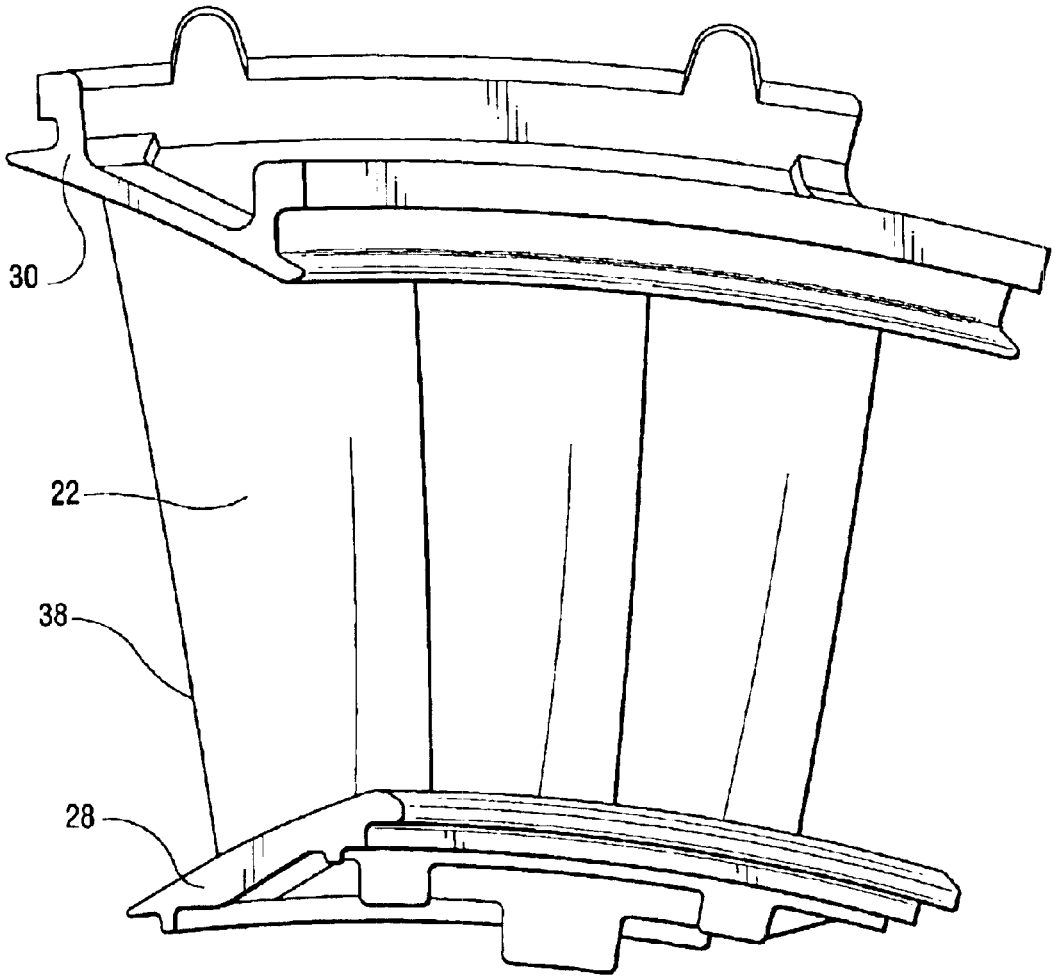
FIG. 3 is a view similar to FIG. 2 as viewed from the leading edges of the blades.
Figure 5:
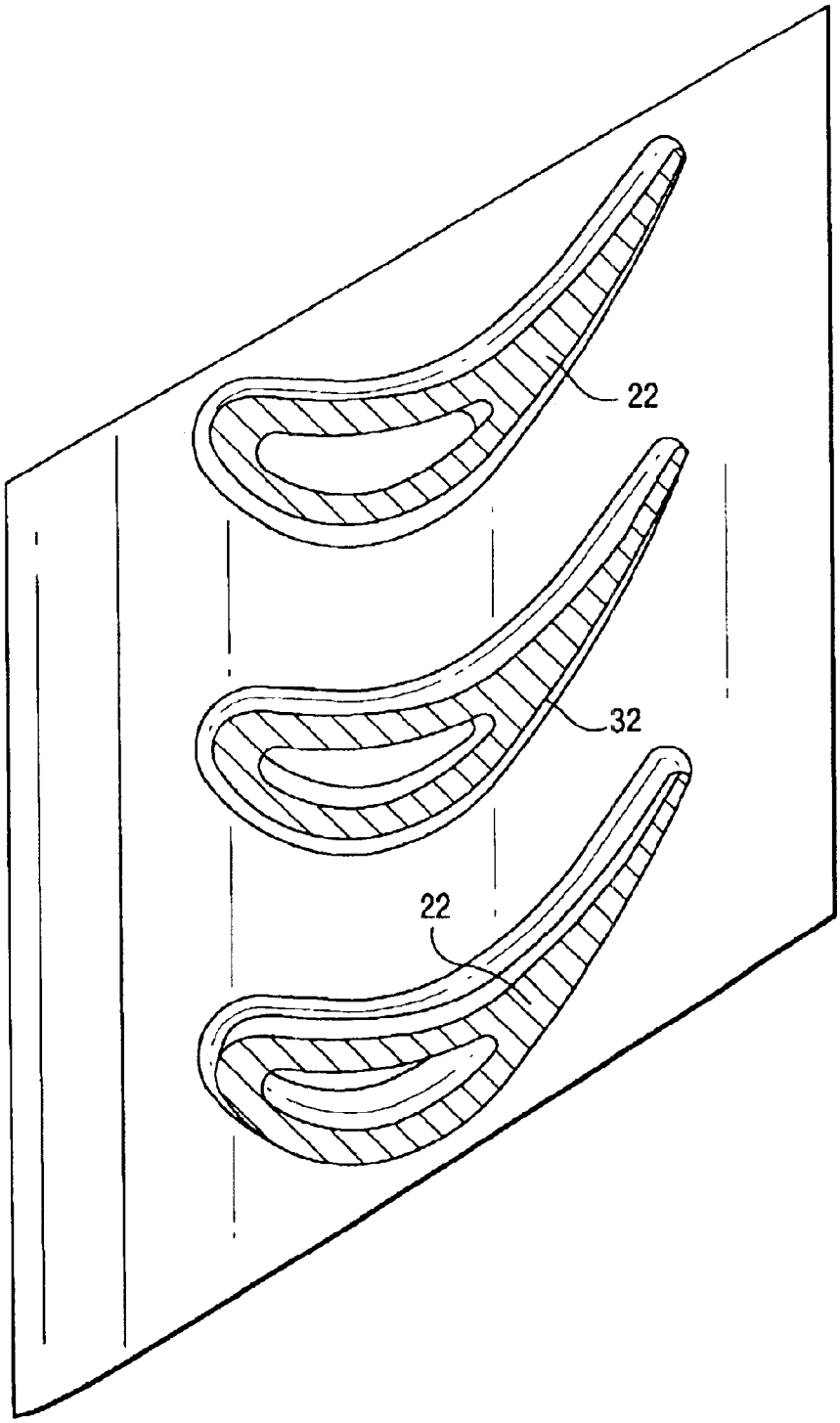
FIG. 5 is a generalized cross-sectional view of the airfoil hereof taken at a location through the third stage nozzle airfoil.

Referring to FIGS. 2 and 3, it will be appreciated that the nozzle stages, for example, the third stage nozzle 22, extend generally radially between inner and outer bands 28 and 30, respectively, which also in part define the hot gas path 26 through turbine 12. Typically, the nozzles 22 are provided as either singlets, doublets or triplets with associated inner and outer bands which are secured together to form a circumferential array of nozzles about the axis of rotation of the rotor. The nozzles 22 are preferably provided in triplets as illustrated. It will be appreciated that each nozzle 22 is in the shape of an airfoil or airfoil-shaped blade 32, as illustrated in FIG. 5. That is, each nozzle 22 has a profile at any cross-section between the inner and outer bands 28 and 30, respectively, in the shape of an airfoil 32. In this preferred embodiment, there are sixty-six (66) nozzle blades in the shape of airfoils 32 which, together with the inner and outer bands 28 and 30, constitute the nozzles 22 of the third stage of the turbine.

Figure 4:
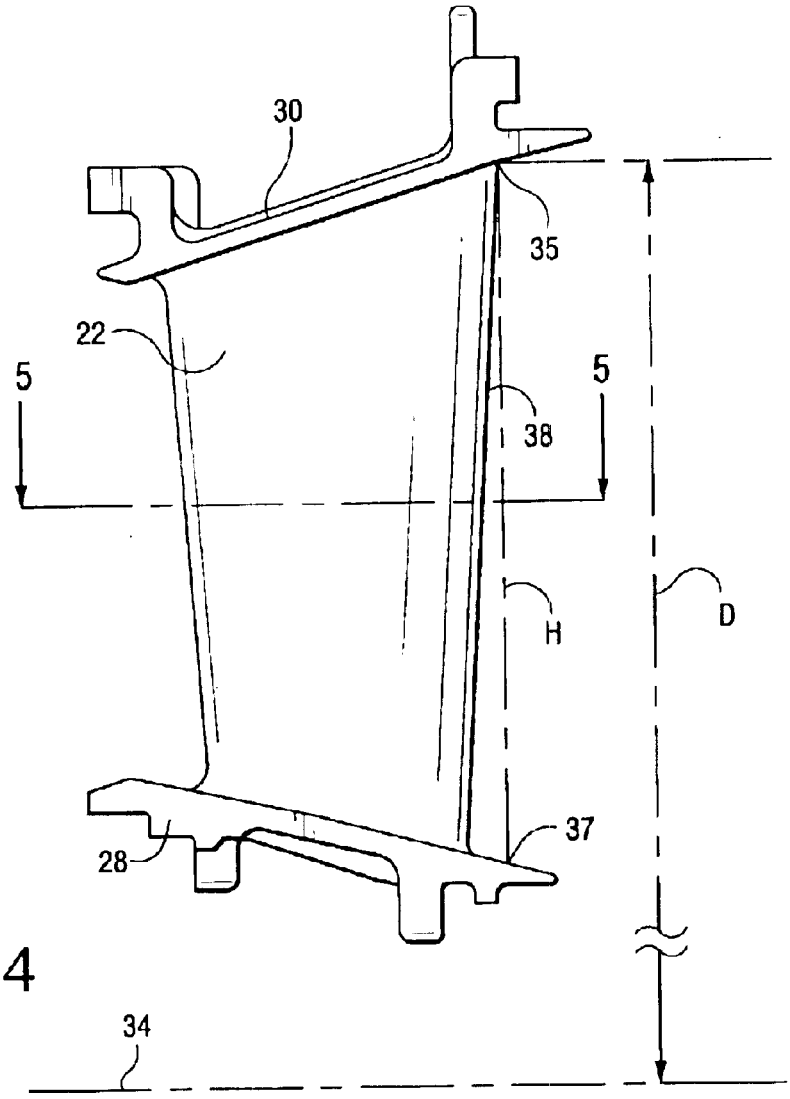
FIG. 4 is a side elevational view of the third stage nozzle airfoil.

To define the airfoil shape of the third stage nozzle airfoil which optimizes the guided hot gas turning and overall efficiency of the turbine, there are a unique set or loci of points in space that meet the stage requirements and can be manufactured. This unique loci of points meets the requirements for nozzle loading and stage efficiency and are arrived at by iteration between aerodynamics and nozzle mechanical loading, enabling the turbine to run in an efficient, safe and smooth manner. The loci which defines the nozzle airfoil profile comprises a set of 600 points. A Cartesian coordinate system of X, Y and Z values given in Table I below defines the profile of each nozzle airfoil. The values for the X and Y coordinates are set forth in inches in Table I, although other units of dimensions may be used when the values are appropriately converted. The Z values set forth in Table I are non-dimensional values from 0 to 1. To convert each Z value to a Z distance in inches, the non-dimensional Z values given in Table I are multiplied by a constant in inches, e.g., the height of the nozzle airfoil. The airfoil height H may be measured from a point at the intersection of the trailing edge 38 of the nozzle 22 and the outer band 30 along a radius which intersects the inner band aft of the trailing edge 38 at 37 (FIG. 4) and is about 8.125 inches. The preferred distance D (FIG. 4) from the point of intersection 35 of each nozzle of the third stage from the rotor axis 34 is 28.930 inches The coordinate system has orthogonally related X, Y and Z axes with the Z axis extending perpendicular to a plane normal to a plane containing the X and Y values. The Y axis lies parallel to the turbine rotor centerline, i.e., the rotary axis 34 and is positive forward to aft. The Z direction is negative in a radial inward direction and the X direction is negative in a tangential counterclockwise direction as viewed in the aft direction.

By defining X and Y coordinate values at selective locations in a Z direction normal to the X, Y plane, the profile of the airfoil at each Z distance can be ascertained. By connecting the X and Y values with smooth continuing arcs, each profile section at each distance Z is fixed. The surface profiles of the various surface locations between the distances Z are determined by smoothly connecting the adjacent cross-sections to one another to form the airfoil. The values set forth in Table I represent the airfoil profiles at ambient, non-operating or non-hot conditions and are for an uncoated airfoil. The sign convention assigns a positive value to Z values and positive and negative values for X and Y coordinates as typically used in the Cartesian coordinate system.

The Table I values are generated and shown to three decimal places for determining the profile of the nozzle airfoil. There are typical manufacturing tolerances, as well as coatings, which must be accounted for in the actual profile of the airfoil. Accordingly, the values for the profile given in Table I are for a nominal airfoil. Thus, the actual profile of the nozzle airfoil may lie in a range of variations between measured points on an airfoil surface and their ideal position as listed in Table I. The design is robust to this variation to the extent that mechanical and aerodynamic functions are not impaired. It will be therefore be appreciated that ± typical manufacturing tolerances, i.e., ± values, including any coating thicknesses, are additive to the X and Y values given in Table I below. Accordingly, a distance of ±0.100 inches in a direction normal to any surface location along the airfoil profile defines an airfoil profile envelope for this particular third stage nozzle airfoil.

The coordinate values are given below in Table I for the preferred nominal profile envelope:

TABLE I

| POINTS | X | Y | Z |
|---|---|---|---|
| 1 | 0.176 | 0.469 | 0.535 |
| 2 | 0.534 | 1.787 | 0.845 |
| 3 | 1.063 | 0.813 | 1.000 |

TABLE I-continued

| POINTS | X | Y | Z |
|---|---|---|---|
| 4 | 0.195 | 0.433 | 0.690 |
| 5 | 0.652 | 1.635 | 0.690 |
| 6 | 0.966 | 0.790 | 0.690 |
| 7 | 0.859 | 0.193 | 0.690 |
| 8 | 0.894 | 0.288 | 0.690 |
| 9 | 0.968 | 0.688 | 0.690 |
| 10 | 0.647 | −0.152 | 0.690 |
| 11 | 0.038 | 1.331 | 0.690 |
| 12 | 0.167 | 0.839 | 0.690 |
| 13 | 0.855 | −0.055 | 0.845 |
| 14 | 0.919 | 0.710 | 0.535 |
| 15 | 0.854 | 1.313 | 1.000 |
| 16 | 0.250 | −0.030 | 0.845 |
| 17 | 0.674 | 1.584 | 1.000 |
| 18 | 0.995 | 1.019 | 1.000 |
| 19 | 0.803 | 0.233 | 0.535 |
| 20 | 0.331 | −0.232 | 0.535 |
| 21 | 0.172 | 0.370 | 0.535 |
| 22 | 0.534 | 1.751 | 1.000 |
| 23 | 0.273 | 0.449 | 1.000 |
| 24 | 0.076 | 1.182 | 1.000 |
| 25 | 0.373 | −0.196 | 1.000 |
| 26 | 0.214 | 0.283 | 0.845 |
| 27 | 0.118 | 1.011 | 0.845 |
| 28 | 0.901 | 0.040 | 0.845 |
| 29 | 0.193 | 0.535 | 0.690 |
| 30 | 0.413 | −0.296 | 1.000 |
| 31 | 0.064 | 1.244 | 0.535 |
| 32 | 0.798 | 1.406 | 1.000 |
| 33 | 0.272 | −0.133 | 0.845 |
| 34 | 0.765 | 0.466 | 0.690 |
| 35 | 0.944 | 0.992 | 0.690 |
| 36 | 0.922 | 0.386 | 0.690 |
| 37 | 0.573 | −0.223 | 0.690 |
| 38 | −0.047 | 1.516 | 0.690 |
| 39 | 0.202 | 0.026 | 0.690 |
| 40 | 0.196 | 0.332 | 0.699 |
| 41 | 0.939 | 0.138 | 0.845 |
| 42 | 0.509 | −0.156 | 0.535 |
| 43 | 0.158 | 0.862 | 0.535 |
| 44 | 0.620 | 1.628 | 0.535 |
| 45 | 0.147 | 0.977 | 1.000 |
| 46 | 0.955 | 1.069 | 0.845 |
| 47 | 0.991 | 0.341 | 0.845 |
| 48 | 0.658 | −0.296 | 0.845 |
| 49 | 0.235 | 0.074 | 0.845 |
| 50 | 0.158 | 0.805 | 0.845 |
| 51 | 1.122 | 0.275 | 1.000 |
| 52 | 0.731 | 1.542 | 0.845 |
| 53 | 1.109 | 0.167 | 1.000 |
| 54 | 0.307 | −0.231 | 0.845 |
| 55 | 0.159 | 0.173 | 0.535 |
| 56 | 0.178 | 0.873 | 1.000 |
| 57 | 0.893 | 1.189 | 0.690 |
| 58 | 0.958 | 0.586 | 0.690 |
| 59 | 0.711 | −0.074 | 0.690 |
| 60 | 0.105 | 1.138 | 0.690 |
| 61 | 0.173 | 0.701 | 0.845 |
| 62 | 0.521 | 1.791 | 0.690 |
| 63 | 0.121 | 1.056 | 0.535 |
| 64 | 0.884 | 1.267 | 0.845 |
| 65 | 1.006 | 0.445 | 0.845 |
| 66 | 0.160 | −0.024 | 0.535 |
| 67 | 0.029 | 1.336 | 0.535 |
| 68 | 0.738 | 1.496 | 1.000 |
| 69 | 0.799 | −0.144 | 0.845 |
| 70 | 0.481 | −0.380 | 1.000 |
| 71 | 1.086 | 0.061 | 1.000 |
| 72 | 1.120 | 0.492 | 1.000 |
| 73 | 0.206 | 0.768 | 1.000 |
| 74 | −0.010 | 1.411 | 0.845 |
| 75 | 0.242 | −0.173 | 0.690 |
| 76 | 0.980 | 0.967 | 0.845 |
| 77 | 0.759 | 0.145 | 0.535 |
| 78 | 0.495 | 1.780 | 0.535 |
| 79 | 0.185 | 0.597 | 0.845 |
| 80 | 0.306 | 0.234 | 1.000 |

TABLE I-continued

| POINTS | X | Y | Z |
|---|---|---|---|
| 81 | 0.142 | 0.959 | 0.535 |
| 82 | 0.588 | 1.714 | 0.690 |
| 83 | 0.488 | −0.278 | 0.690 |
| 84 | 0.198 | 0.128 | 0.690 |
| 85 | 0.179 | 0.738 | 0.690 |
| 86 | 0.677 | 1.548 | 0.535 |
| 87 | 0.462 | −0.360 | 0.845 |
| 88 | −0.054 | 1.506 | 0.845 |
| 89 | 0.095 | 1.151 | 0.535 |
| 90 | 0.608 | 1.669 | 1.000 |
| 91 | 0.035 | 1.283 | 1.000 |
| 92 | 1.011 | 0.760 | 0.845 |
| 93 | 0.350 | −0.089 | 1.000 |
| 94 | 0.872 | −0.312 | 1.000 |
| 95 | 1.089 | 0.707 | 1.000 |
| 96 | 0.910 | 0.612 | 0.535 |
| 97 | 0.559 | 1.706 | 0.535 |
| 98 | 0.196 | 0.492 | 0.845 |
| 99 | 0.335 | 0.018 | 1.000 |
| 100 | 0.788 | 1.453 | 0.845 |
| 101 | −0.110 | 1.575 | 1.000 |
| 102 | 0.711 | 1.552 | 0.690 |
| 103 | 0.958 | 0.891 | 0.690 |
| 104 | 0.944 | 0.486 | 0.690 |
| 105 | 0.389 | −0.297 | 0.690 |
| 106 | 0.253 | 0.556 | 1.000 |
| 107 | 0.074 | 1.235 | 0.690 |
| 108 | 0.151 | 0.940 | 0.690 |
| 109 | 0.906 | 1.217 | 1.000 |
| 110 | 1.014 | 0.550 | 0.845 |
| 111 | 0.205 | 0.388 | 0.845 |
| 112 | 0.953 | 1.119 | 1.000 |
| 113 | 0.841 | 0.325 | 0.535 |
| 114 | −0.104 | 1.600 | 0.535 |
| 115 | 0.291 | 0.341 | 1.000 |
| 116 | 0.113 | 1.080 | 1.000 |
| 117 | 0.670 | 1.627 | 0.845 |
| 118 | 0.969 | 0.238 | 0.845 |
| 119 | 0.565 | −0.348 | 0.845 |
| 120 | 0.224 | 0.178 | 0.845 |
| 121 | 0.140 | 0.909 | 0.845 |
| 122 | −0.102 | 1.600 | 0.845 |
| 123 | 0.240 | −0.199 | 0.535 |
| 124 | −0.095 | 1.605 | 0.690 |
| 125 | 0.166 | 0.272 | 0.535 |
| 126 | 0.029 | 1.313 | 0.848 |
| 127 | 0.786 | −0.377 | 1.000 |
| 128 | 1.016 | 0.655 | 0.845 |
| 129 | 0.813 | 1.376 | 0.690 |
| 130 | 0.922 | 1.091 | 0.690 |
| 131 | 0.768 | 0.011 | 0.690 |
| 132 | 0.298 | −0.256 | 0.690 |
| 133 | 0.214 | −0.075 | 0.690 |
| 134 | 0.196 | 0.230 | 0.690 |
| 135 | 0.175 | 0.666 | 0.535 |
| 136 | 0.733 | −0.025 | 0.845 |
| 137 | 0.871 | 0.419 | 0.535 |
| 138 | 0.649 | −0.018 | 0.535 |
| 139 | 0.583 | −0.091 | 0.535 |
| 140 | 0.155 | 0.075 | 0.535 |
| 141 | 0.169 | 0.764 | 0.535 |
| 142 | 0.923 | 1.169 | 0.845 |
| 143 | 0.321 | 0.126 | 1.000 |
| 144 | 0.579 | −0.425 | 1.000 |
| 145 | 1.032 | 0.917 | 1.000 |
| 146 | 1.125 | 0.383 | 1.000 |
| 147 | 0.063 | 1.214 | 0.845 |
| 148 | 0.668 | −0.420 | 1.000 |
| 149 | −0.056 | 1.514 | 0.535 |
| 150 | 0.894 | 0.514 | 0.535 |
| 151 | 0.604 | 1.709 | 0.845 |
| 152 | 1.005 | −0.141 | 1.000 |
| 153 | 0.856 | 1.284 | 0.690 |
| 154 | 0.818 | 0.100 | 0.690 |
| 155 | 0.130 | 1.040 | 0.690 |
| 156 | 0.188 | 0.637 | 0.690 |
| 157 | 0.426 | −0.209 | 0.535 |

TABLE I-continued

| POINTS | X | Y | Z |
|---|---|---|---|
| 158 | −0.002 | 1.424 | 0.690 |
| 159 | 0.093 | 1.113 | 0.845 |
| 160 | 0.368 | −0.316 | 0.845 |
| 161 | −0.012 | 1.426 | 0.535 |
| 162 | 1.052 | −0.042 | 1.000 |
| 163 | 0.999 | 0.864 | 0.845 |
| 164 | 0.707 | 0.061 | 0.535 |
| 165 | 0.184 | −0.119 | 0.535 |
| 166 | 0.178 | 0.567 | 0.535 |
| 167 | 0.231 | 0.662 | 1.000 |
| 168 | −0.010 | 1.382 | 1.000 |
| 169 | 1.108 | 0.600 | 1.000 |
| 170 | 0.946 | −0.231 | 1.000 |
| 171 | −0.058 | 1.480 | 1.000 |
| 172 | 0.839 | 1.361 | 0.845 |
| 173 | −1.749 | 3.192 | 1.000 |
| 174 | −1.775 | 3.137 | 0.535 |
| 175 | 0.220 | 2.051 | 1.000 |
| 176 | −0.532 | 2.140 | 0.535 |
| 177 | −0.464 | 2.090 | 0.690 |
| 178 | −0.266 | 1.858 | 0.690 |
| 179 | −1.234 | 2.738 | 1.000 |
| 180 | −0.700 | 2.326 | 0.845 |
| 181 | −1.914 | 3.150 | 0.845 |
| 182 | −0.293 | 2.430 | 0.845 |
| 183 | −1.311 | 2.975 | 0.845 |
| 184 | −1.454 | 3.024 | 0.690 |
| 185 | −1.085 | 2.852 | 0.690 |
| 186 | −0.791 | 2.681 | 0.535 |
| 187 | −0.531 | 2.540 | 0.535 |
| 188 | −1.234 | 2.899 | 0.535 |
| 189 | −1.058 | 2.586 | 0.535 |
| 190 | −1.958 | 3.212 | 0.535 |
| 191 | −1.866 | 3.175 | 0.535 |
| 192 | −0.148 | 1.692 | 0.690 |
| 193 | −0.760 | 2.370 | 0.690 |
| 194 | −1.468 | 2.860 | 0.535 |
| 195 | 0.130 | 2.112 | 0.535 |
| 196 | −2.050 | 3.319 | 1.000 |
| 197 | −1.354 | 3.010 | 1.000 |
| 198 | −0.679 | 2.659 | 1.000 |
| 199 | −0.037 | 2.252 | 1.000 |
| 200 | −0.288 | 1.848 | 1.000 |
| 201 | −0.805 | 2.404 | 1.000 |
| 202 | −1.414 | 2.860 | 1.000 |
| 203 | −2.069 | 3.246 | 1.000 |
| 204 | 0.136 | 2.120 | 1.000 |
| 205 | −1.145 | 2.675 | 1.000 |
| 206 | −0.382 | 2.485 | 0.845 |
| 207 | 0.283 | 1.987 | 0.535 |
| 208 | −0.422 | 2.019 | 1.000 |
| 209 | −0.967 | 2.770 | 0.535 |
| 210 | −1.681 | 3.005 | 0.690 |
| 211 | −1.406 | 3.020 | 0.845 |
| 212 | −0.329 | 1.938 | 0.690 |
| 213 | −0.942 | 2.527 | 0.845 |
| 214 | −0.157 | 1.684 | 0.535 |
| 215 | 0.051 | 2.171 | 0.535 |
| 216 | −1.693 | 3.149 | 0.845 |
| 217 | −0.108 | 2.306 | 0.690 |
| 218 | −1.828 | 3.185 | 0.690 |
| 219 | −0.902 | 2.761 | 0.690 |
| 220 | 0.376 | 1.934 | 0.690 |
| 221 | −0.704 | 2.635 | 0.535 |
| 222 | −0.901 | 2.467 | 0.535 |
| 223 | −1.164 | 2.679 | 0.690 |
| 224 | −1.958 | 3.212 | 0.535 |
| 225 | −0.211 | 1.779 | 0.845 |
| 226 | −0.397 | 1.997 | 0.535 |
| 227 | −1.731 | 3.047 | 0.845 |
| 228 | −0.404 | 2.028 | 0.845 |
| 229 | −1.550 | 2.940 | 0.845 |
| 230 | −1.551 | 3.103 | 1.000 |
| 231 | −0.463 | 2.069 | 0.535 |
| 232 | −0.110 | 2.284 | 0.535 |
| 233 | 0.057 | 2.198 | 0.845 |
| 274 | −0.645 | 2.257 | 1.000 |

TABLE I-continued

| POINTS | X | Y | Z |
|---|---|---|---|
| 235 | −0.870 | 2.764 | 1.000 |
| 238 | −0.860 | 2.462 | 0.845 |
| 237 | −1.879 | 3.141 | 1.000 |
| 238 | −1.948 | 3.153 | 0.690 |
| 239 | 0.306 | 2.004 | 0.845 |
| 240 | −1.081 | 2.620 | 0.690 |
| 241 | −2.017 | 3.261 | 0.690 |
| 242 | −1.886 | 3.231 | 0.845 |
| 243 | −0.193 | 2.362 | 0.690 |
| 244 | −1.361 | 2.982 | 0.690 |
| 245 | −0.722 | 2.667 | 0.690 |
| 246 | 0.222 | 2.067 | 0.690 |
| 247 | −1.056 | 2.814 | 0.535 |
| 248 | −1.144 | 2.857 | 0.535 |
| 249 | −1.684 | 3.099 | 0.535 |
| 250 | −0.749 | 2.341 | 0.535 |
| 251 | −1.301 | 2.754 | 0.535 |
| 252 | −1.894 | 3.107 | 0.535 |
| 253 | −0.395 | 2.015 | 0.690 |
| 254 | −0.564 | 2.590 | 0.845 |
| 255 | 0.427 | 1.852 | 0.535 |
| 256 | −0.272 | 1.865 | 0.845 |
| 257 | −0.779 | 2.395 | 0.845 |
| 258 | −0.332 | 1.922 | 0.535 |
| 259 | −0.276 | 2.390 | 0.535 |
| 260 | −0.748 | 2.691 | 0.845 |
| 261 | −0.115 | 2.317 | 0.845 |
| 262 | 0.461 | 1.862 | 0.845 |
| 263 | −1.058 | 2.610 | 1.000 |
| 264 | −1.691 | 3.032 | 1.000 |
| 265 | −1.949 | 3.277 | 1.000 |
| 266 | −0.205 | 1.776 | 0.690 |
| 267 | 0.225 | 2.071 | 0.845 |
| 268 | −1.637 | 2.962 | 0.535 |
| 269 | −1.552 | 2.911 | 0.535 |
| 270 | −0.125 | 2.315 | 1.000 |
| 271 | −1.769 | 3.055 | 0.690 |
| 272 | 0.385 | 1.935 | 0.845 |
| 273 | −0.361 | 2.441 | 0.535 |
| 274 | −1.062 | 2.865 | 1.000 |
| 275 | −1.248 | 2.736 | 0.690 |
| 276 | −0.999 | 2.560 | 0.690 |
| 277 | −0.279 | 2.416 | 0.690 |
| 278 | −0.367 | 2.468 | 0.690 |
| 279 | −1.547 | 3.065 | 0.690 |
| 280 | −0.454 | 2.520 | 0.690 |
| 281 | −0.879 | 2.726 | 0.535 |
| 282 | −0.617 | 2.588 | 0.535 |
| 283 | −1.503 | 3.021 | 0.535 |
| 284 | −1.138 | 2.643 | 0.535 |
| 285 | −1.722 | 3.011 | 0.535 |
| 286 | −0.838 | 2.435 | 0.690 |
| 287 | 0.142 | 2.135 | 0.845 |
| 288 | −0.494 | 2.101 | 1.000 |
| 289 | −0.154 | 1.691 | 0.845 |
| 290 | −0.622 | 2.255 | 0.845 |
| 291 | −1.197 | 2.713 | 0.845 |
| 292 | −1.822 | 3.099 | 0.845 |
| 293 | −1.256 | 2.963 | 1.000 |
| 294 | −0.585 | 2.605 | 1.000 |
| 295 | 0.051 | 2.187 | 1.000 |
| 296 | −0.934 | 2.789 | 0.845 |
| 297 | −0.353 | 1.935 | 1.000 |
| 298 | −0.888 | 2.475 | 1.000 |
| 299 | −2.166 | 3.296 | 1.000 |
| 300 | −0.212 | 1.765 | 0.535 |
| 301 | −1.461 | 2.885 | 0.845 |
| 302 | −1.284 | 2.771 | 0.845 |
| 303 | −1.159 | 2.914 | 1.000 |
| 304 | −2.038 | 3.201 | 0.690 |
| 305 | −1.216 | 2.930 | 0.845 |
| 306 | 0.142 | 2.130 | 0.690 |
| 307 | −1.984 | 3.271 | 0.845 |
| 308 | −0.993 | 2.807 | 0.690 |
| 309 | 0.300 | 2.002 | 0.690 |
| 310 | −0.446 | 2.491 | 0.535 |
| 311 | −0.675 | 2.276 | 0.535 |

TABLE I-continued

| POINTS | X | Y | Z |
|---|---|---|---|
| 312 | −1.413 | 2.981 | 0.535 |
| 313 | −0.535 | 2.163 | 0.690 |
| 314 | −0.608 | 2.234 | 0.690 |
| 315 | −1.858 | 3.105 | 0.690 |
| 316 | −0.306 | 2.435 | 1.000 |
| 317 | −0.683 | 2.303 | 0.690 |
| 318 | −0.724 | 2.332 | 1.000 |
| 319 | −1.372 | 2.829 | 0.845 |
| 320 | −0.841 | 2.741 | 0.845 |
| 321 | −1.026 | 2.590 | 0.845 |
| 322 | −1.640 | 2.994 | 0.845 |
| 323 | −2.150 | 3.360 | 1.000 |
| 324 | −0.774 | 2.712 | 1.000 |
| 325 | −0.029 | 2.228 | 0.535 |
| 326 | 0.460 | 1.830 | 1.000 |
| 327 | −0.225 | 1.760 | 1.000 |
| 328 | −1.323 | 2.800 | 1.000 |
| 329 | −1.974 | 3.194 | 1.000 |
| 330 | −0.547 | 2.182 | 0.845 |
| 331 | −0.166 | 1.669 | 1.000 |
| 332 | −1.505 | 2.919 | 1.000 |
| 333 | −2.081 | 3.310 | 0.845 |
| 334 | −0.398 | 2.493 | 1.000 |
| 335 | −1.333 | 2.792 | 0.690 |
| 336 | −1.419 | 2.847 | 0.690 |
| 337 | −1.790 | 3.191 | 0.845 |
| 338 | 0.060 | 2.191 | 0.690 |
| 339 | −1.177 | 2.898 | 0.690 |
| 340 | −1.501 | 3.064 | 0.845 |
| 341 | −0.812 | 2.715 | 0.690 |
| 342 | 0.450 | 1.864 | 0.690 |
| 343 | −1.323 | 2.940 | 0.535 |
| 344 | −0.824 | 2.405 | 0.535 |
| 345 | −1.384 | 2.808 | 0.535 |
| 346 | −1.981 | 3.153 | 0.535 |
| 347 | −2.017 | 3.261 | 0.690 |
| 348 | −1.593 | 2.953 | 0.690 |
| 349 | −0.918 | 2.498 | 0.690 |
| 350 | −2.081 | 3.310 | 0.845 |
| 351 | −0.474 | 2.106 | 0.845 |
| 352 | 0.382 | 1.906 | 1.000 |
| 353 | 0.207 | 2.050 | 0.535 |
| 354 | −0.473 | 2.538 | 0.845 |
| 355 | −0.336 | 1.948 | 0.845 |
| 356 | −1.650 | 3.148 | 1.000 |
| 357 | −0.966 | 2.815 | 1.000 |
| 358 | −0.193 | 2.338 | 0.535 |
| 359 | 0.356 | 1.921 | 0.535 |
| 360 | −0.656 | 2.641 | 0.845 |
| 361 | −0.028 | 2.258 | 0.845 |
| 362 | −0.215 | 2.376 | 1.000 |
| 363 | −1.784 | 3.087 | 1.000 |
| 364 | −2.100 | 3.248 | 0.845 |
| 365 | −0.568 | 2.180 | 1.000 |
| 366 | −1.028 | 2.837 | 0.845 |
| 367 | −0.979 | 2.527 | 0.535 |
| 368 | −1.452 | 3.057 | 1.000 |
| 369 | −1.506 | 2.901 | 0.690 |
| 370 | −1.597 | 3.107 | 0.845 |
| 371 | −1.922 | 3.223 | 0.690 |
| 372 | −0.023 | 2.249 | 0.690 |
| 373 | −1.269 | 2.939 | 0.690 |
| 374 | −1.640 | 3.106 | 0.690 |
| 375 | −0.632 | 2.619 | 0.690 |
| 376 | −1.734 | 3.146 | 0.690 |
| 377 | 0.302 | 1.980 | 1.000 |
| 378 | −0.602 | 2.209 | 0.535 |
| 379 | −1.593 | 3.060 | 0.535 |
| 380 | −1.219 | 2.699 | 0.535 |
| 381 | −1.808 | 3.059 | 0.535 |
| 382 | −0.543 | 2.570 | 0.690 |
| 383 | −2.006 | 3.200 | 0.845 |
| 384 | −0.204 | 2.374 | 0.845 |
| 385 | −1.849 | 3.235 | 1.000 |
| 386 | −0.271 | 1.845 | 0.535 |
| 387 | −0.491 | 2.550 | 1.000 |
| 388 | −0.972 | 2.543 | 1.000 |

TABLE I-continued

| POINTS | X | Y | Z |
|---|---|---|---|
| 389 | −1.598 | 2.976 | 1.000 |
| 390 | −2.150 | 3.360 | 1.000 |
| 391 | −1.111 | 2.652 | 0.845 |
| 392 | −1.122 | 2.884 | 0.845 |
| 393 | −0.135 | 0.100 | 0.000 |
| 394 | 0.026 | 0.318 | 0.268 |
| 395 | 0.502 | 0.272 | 0.000 |
| 396 | −0.149 | 1.128 | 0.000 |
| 397 | 0.795 | 0.643 | 0.268 |
| 398 | 0.015 | 0.964 | 0.268 |
| 399 | 0.546 | 0.346 | 0.000 |
| 400 | 0.470 | 1.671 | 0.268 |
| 401 | 0.315 | −0.099 | 0.268 |
| 402 | 0.649 | 0.207 | 0.268 |
| 403 | 0.035 | 0.688 | 0.268 |
| 404 | 0.000 | 1.055 | 0.268 |
| 405 | 0.627 | 1.443 | 0.268 |
| 406 | 0.780 | 0.551 | 0.268 |
| 407 | 0.392 | 0.139 | 0.000 |
| 408 | 0.423 | 1.568 | 0.000 |
| 409 | 0.584 | 0.424 | 0.000 |
| 410 | −0.174 | 0.353 | 0.000 |
| 411 | 0.817 | 1.287 | 0.535 |
| 412 | 0.591 | 1.267 | 0.000 |
| 413 | 0.410 | 1.741 | 0.268 |
| 414 | 0.000 | 0.000 | 0.000 |
| 415 | 0.473 | −0.005 | 0.268 |
| 416 | 0.540 | 0.059 | 0.268 |
| 417 | 0.020 | 0.133 | 0.268 |
| 418 | −0.041 | 1.236 | 0.268 |
| 419 | 0.758 | 0.462 | 0.268 |
| 420 | 0.851 | 1.195 | 0.535 |
| 421 | 0.776 | 1.377 | 0.535 |
| 422 | 0.556 | 1.346 | 0.000 |
| 423 | 0.516 | 1.422 | 0.000 |
| 424 | −0.237 | 1.462 | 0.000 |
| 425 | 0.708 | 1.277 | 0.268 |
| 426 | 0.314 | 1.702 | 0.000 |
| 427 | 0.619 | 1.185 | 0.000 |
| 428 | 0.638 | 0.588 | 0.000 |
| 429 | 0.326 | 0.084 | 0.000 |
| 430 | −0.165 | 0.181 | 0.000 |
| 431 | −0.134 | 0.783 | 0.000 |
| 432 | −0.208 | 1.360 | 0.000 |
| 433 | 0.693 | 0.289 | 0.268 |
| 434 | 0.065 | −0.043 | 0.268 |
| 435 | 0.036 | 0.595 | 0.268 |
| 436 | −0.099 | 1.411 | 0.268 |
| 437 | 0.032 | 0.780 | 0.268 |
| 438 | 0.740 | 1.190 | 0.268 |
| 439 | 0.729 | 1.464 | 0.535 |
| 440 | 0.901 | 1.004 | 0.535 |
| 441 | −0.157 | 0.525 | 0.000 |
| 442 | 0.579 | 1.522 | 0.268 |
| 443 | 0.171 | 0.009 | 0.000 |
| 444 | 0.804 | 0.827 | 0.268 |
| 445 | 0.451 | 0.202 | 0.000 |
| 446 | −0.147 | 0.611 | 0.000 |
| 447 | −0.164 | 1.213 | 0.000 |
| 448 | −0.068 | 1.324 | 0.268 |
| 449 | 0.729 | 0.374 | 0.268 |
| 450 | 0.030 | 0.041 | 0.268 |
| 451 | 0.766 | 1.101 | 0.268 |
| 452 | 0.255 | −0.118 | 0.268 |
| 453 | −0.175 | 1.580 | 0.268 |
| 454 | 0.251 | 0.040 | 0.000 |
| 455 | 0.666 | 0.758 | 0.000 |
| 456 | 0.472 | 1.496 | 0.000 |
| 457 | 0.667 | 0.931 | 0.000 |
| 458 | 0.086 | −0.006 | 0.000 |
| 459 | −0.167 | 0.439 | 0.000 |
| 460 | −0.139 | 1.042 | 0.000 |
| 461 | 0.788 | 1.011 | 0.268 |
| 462 | 0.670 | 1.361 | 0.268 |
| 463 | 0.598 | 0.130 | 0.268 |
| 464 | −0.018 | 1.148 | 0.268 |
| 465 | 0.670 | 0.844 | 0.000 |

TABLE I-continued

| POINTS | X | Y | Z |
|---|---|---|---|
| 466 | 0.798 | 0.919 | 0.268 |
| 467 | −0.132 | 0.870 | 0.000 |
| 468 | 0.370 | 1.636 | 0.000 |
| 469 | 0.642 | 1.102 | 0.000 |
| 470 | 0.614 | 0.505 | 0.000 |
| 471 | −0.078 | 0.036 | 0.000 |
| 472 | −0.134 | 0.956 | 0.000 |
| 473 | −0.175 | 0.267 | 0.000 |
| 474 | 0.022 | 0.226 | 0.268 |
| 475 | 0.879 | 1.101 | 0.535 |
| 476 | 0.254 | 1.765 | 0.000 |
| 477 | 0.655 | 0.672 | 0.000 |
| 478 | 0.658 | 1.017 | 0.000 |
| 479 | −0.139 | 0.697 | 0.000 |
| 480 | −0.184 | 1.297 | 0.000 |
| 481 | 0.526 | 1.598 | 0.268 |
| 482 | 0.398 | −0.059 | 0.268 |
| 483 | −0.269 | 1.542 | 0.000 |
| 484 | 0.803 | 0.735 | 0.268 |
| 485 | 0.134 | −0.103 | 0.268 |
| 486 | 0.034 | 0.503 | 0.268 |
| 487 | 0.030 | 0.410 | 0.268 |
| 488 | −0.135 | 1.496 | 0.268 |
| 489 | 0.025 | 0.872 | 0.268 |
| 490 | 0.914 | 0.907 | 0.535 |
| 491 | 0.920 | 0.808 | 0.535 |
| 492 | −0.598 | 2.047 | 0.000 |
| 493 | −1.532 | 2.809 | 0.000 |
| 494 | −0.871 | 2.561 | 0.000 |
| 495 | −0.355 | 2.245 | 0.000 |
| 496 | −1.402 | 2.851 | 0.000 |
| 497 | −0.655 | 2.111 | 0.000 |
| 498 | −0.003 | 2.110 | 0.268 |
| 499 | −1.112 | 2.584 | 0.268 |
| 500 | −1.656 | 2.934 | 0.268 |
| 501 | −0.615 | 2.170 | 0.268 |
| 502 | −0.218 | 1.661 | 0.268 |
| 503 | −0.306 | 1.620 | 0.000 |
| 504 | −1.246 | 2.616 | 0.000 |
| 505 | 0.129 | 1.883 | 0.000 |
| 506 | −1.388 | 2.715 | 0.000 |
| 507 | −1.790 | 3.041 | 0.000 |
| 508 | −0.946 | 2.604 | 0.000 |
| 509 | −0.501 | 2.339 | 0.000 |
| 510 | −0.004 | 1.994 | 0.000 |
| 511 | −0.078 | 2.164 | 0.268 |
| 512 | −0.964 | 2.473 | 0.268 |
| 513 | −1.362 | 2.896 | 0.268 |
| 514 | −0.787 | 2.600 | 0268 |
| 515 | −0.309 | 2.319 | 0.268 |
| 516 | −0.820 | 2.357 | 0.268 |
| 517 | −1.498 | 2.838 | 0.268 |
| 518 | −1.790 | 3.041 | 0.000 |
| 519 | −0.317 | 1.818 | 0.268 |
| 520 | −0.626 | 2.509 | 0.268 |
| 521 | −1.826 | 2.992 | 0.000 |
| 522 | −1.445 | 2.936 | 0.268 |
| 523 | −0.891 | 2.416 | 0.268 |
| 524 | −0.391 | 1.771 | 0.000 |
| 525 | −0.777 | 2.234 | 0.000 |
| 526 | −1.753 | 2.946 | 0.000 |
| 527 | −0.648 | 2.429 | 0.000 |
| 528 | −1.529 | 2.975 | 0.268 |
| 529 | −0.154 | 2.217 | 0.268 |
| 530 | −1.341 | 2.739 | 0.268 |
| 531 | −1.896 | 3.072 | 0.268 |
| 532 | −0.428 | 1.965 | 0.268 |
| 533 | −0.231 | 2.269 | 0.268 |
| 534 | −1.557 | 2.929 | 0.000 |
| 535 | −1.249 | 2.771 | 0.000 |
| 536 | −1.106 | 2.514 | 0.000 |
| 537 | −0.283 | 2.197 | 0.000 |
| 538 | 0.193 | 1.825 | 0.000 |
| 539 | 0.070 | 2.054 | 0.268 |
| 540 | −1.697 | 3.052 | 0.268 |
| 541 | −1.114 | 2.773 | 0.268 |
| 542 | −1.188 | 2.637 | 0.268 |

TABLE I-continued

| POINTS | X | Y | Z |
|---|---|---|---|
| 543 | −1.736 | 2.980 | 0.268 |
| 544 | −1.634 | 2.967 | 0.000 |
| 545 | −0.750 | 2.297 | 0.268 |
| 546 | −0.550 | 2.104 | 0.268 |
| 547 | −0.868 | 2.644 | 0.268 |
| 548 | −0.542 | 1.981 | 0.000 |
| 549 | −0.971 | 2.406 | 0.000 |
| 550 | −1.460 | 2.762 | 0.000 |
| 551 | −0.797 | 2.517 | 0.000 |
| 552 | −0.387 | 2.368 | 0.268 |
| 553 | −0.905 | 2.350 | 0.000 |
| 554 | −1.279 | 2.855 | 0.268 |
| 555 | 0.281 | 1.873 | 0.268 |
| 556 | −1.037 | 2.529 | 0.268 |
| 557 | −1.577 | 2.886 | 0.268 |
| 558 | −1.712 | 3.005 | 0.000 |
| 559 | −0.950 | 2.687 | 0.268 |
| 560 | −0.681 | 2.234 | 0.268 |
| 561 | −0.266 | 1.741 | 0.268 |
| 562 | −0.466 | 2.416 | 0.268 |
| 563 | −1.782 | 3.090 | 0.268 |
| 564 | −0.438 | 1.843 | 0.000 |
| 565 | −0.840 | 2.293 | 0.000 |
| 566 | −1.316 | 2.666 | 0.000 |
| 567 | −0.574 | 2.384 | 0.000 |
| 568 | −0.072 | 2.047 | 0.000 |
| 569 | −0.489 | 1.913 | 0.000 |
| 570 | 0.212 | 1.936 | 0.268 |
| 571 | −0.706 | 2.555 | 0.268 |
| 572 | −0.142 | 2.098 | 0.000 |
| 573 | −1.022 | 2.646 | 0.000 |
| 574 | −0.546 | 2.463 | 0.268 |
| 575 | −1.419 | 2.789 | 0.268 |
| 576 | −1.867 | 3.127 | 0.268 |
| 577 | −1.328 | 2.811 | 0.000 |
| 578 | −1.867 | 3.127 | 0.268 |
| 579 | −1.097 | 2.688 | 0.000 |
| 580 | −0.371 | 1.893 | 0.268 |
| 581 | −1.038 | 2.461 | 0.000 |
| 582 | −1.173 | 2.730 | 0.000 |
| 583 | −1.605 | 2.856 | 0.000 |
| 584 | −0.347 | 1.696 | 0.000 |
| 585 | 0.142 | 1.996 | 0.268 |
| 586 | −1.176 | 2.565 | 0.000 |
| 587 | −1.679 | 2.901 | 0.000 |
| 588 | 0.063 | 1.940 | 0.000 |
| 589 | −0.212 | 2.148 | 0.000 |
| 590 | −0.722 | 2.474 | 0.000 |
| 591 | 0.347 | 1.809 | 0.268 |
| 592 | −1.613 | 3.014 | 0.268 |
| 593 | −1.032 | 2.730 | 0.268 |
| 594 | −0.715 | 2.174 | 0.000 |
| 565 | −1.264 | 2.689 | 0.268 |
| 596 | −1.816 | 3.026 | 0.268 |
| 597 | −1.479 | 2.890 | 0.000 |
| 598 | −0.488 | 2.036 | 0.268 |
| 599 | −0.428 | 2.292 | 0.000 |
| 600 | −1.196 | 2.814 | 0.268 |

It will also be appreciated that the airfoil profile disclosed in the above table may be scaled up or down geometrically for use in other similar turbine designs. Consequently, the coordinate values set forth in Table I may be scaled upwardly or downwardly such that the airfoil section shape remains unchanged. A scaled version of the coordinates in Table I is represented by X, Y and Z distances in inches, multiplied or divided by a constant number.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine nozzle including an airfoil having an airfoil shape, said airfoil having a nominal profile substantially in accordance with Cartesian coordinate values of X, Y and Z set forth in Table I wherein the Z values are non-dimensional values from 0 to 1 convertible to Z distances in inches by multiplying the Z values of Table I by a height of the airfoil in inches, and wherein the X and Y values are distances in inches which, when connected by smooth continuing arcs, define airfoil profile sections at each distance Z, the profile sections at the Z distances being joined smoothly with one another to form a complete airfoil shape.

2. A turbine nozzle according to claim 1 forming part of a third stage of a turbine.

3. A turbine nozzle according to claim 1 wherein said airfoil shape lies in an envelope within ±0.100 inches in a direction normal to any airfoil surface location therealong.

4. A turbine nozzle according to claim 1 wherein each said airfoil shape lies in an envelope within ±0.100 inches in a direction normal to any airfoil surface location therealong.

5. A turbine nozzle including an airfoil having an uncoated nominal airfoil profile substantially in accordance with Cartesian coordinate values of X, Y and Z set forth in Table I wherein the Z values are non-dimensional values from 0 to 1 convertible to Z distances in inches by multiplying the Z values of Table I by a height of the airfoil in inches, and wherein the X and Y values are distances in inches which, when connected by smooth continuing arcs, define airfoil profile sections at each distance Z, the profile sections at the Z distances being joined smoothly with one another to form a complete airfoil shape, the X, Y and Z distances being scalable as a function of the same constant or number to provide a scaled-up or scaled-down airfoil.

6. A turbine nozzle according to claim 5 forming part of a third stage of a turbine.

7. A turbine comprising a turbine stage having a plurality of nozzles, each of said nozzles including an airfoil having an airfoil shape, said airfoil having a nominal profile substantially in accordance with Cartesian coordinate values of X, Y and Z set forth in Table I wherein the Z values are non-dimensional values from 0 to 1 convertible to Z distances in inches by multiplying the Z values of Table I by a height of the airfoil in inches, and wherein X and Y values are distances in inches which, when connected by smooth continuing arcs, define airfoil profile sections at each distance Z, the profile sections at the Z distances being joined smoothly with one another to form a complete airfoil shape.

8. A turbine according to claim 7 wherein the turbine nozzles comprises part of a third stage of the turbine.

9. A turbine according to claim 8 wherein the turbine stage has 66 nozzles and the coordinate value Y extends parallel to an axis of rotation of the turbine.

10. A turbine according to claim 7 wherein each said airfoil shape lies in an envelope within ±0.100 inches in a direction normal to any airfoil surface location therealong.

* * * * *